United States Patent [19]

Wolf et al.

[11] 4,081,321

[45] Mar. 28, 1978

[54] MOVABLE DECKLE WITHIN HEADBOX OUTLET

[75] Inventors: Jakob Wolf; Iwan Lasschuit, both of Heidenheim, Germany

[73] Assignee: J. M. Voith GmbH, Heidenheim, Germany

[21] Appl. No.: 735,081

[22] Filed: Oct. 22, 1976

[30] Foreign Application Priority Data

Nov. 6, 1975 Germany ..... 2549726

[51] Int. Cl.[2] ..... D21F 1/02

[52] U.S. Cl. ..... 162/346; 162/351; 162/353; 162/366

[58] Field of Search ..... 162/336, 346, 350, 351, 162/353, 366, 343

[56] References Cited

U.S. PATENT DOCUMENTS

| | | | |
|---|---|---|---|
| 1,342,655 | 6/1920 | Van Ornum | 162/353 X |
| 1,734,929 | 11/1929 | Vedder | 162/353 X |
| 3,361,620 | 1/1968 | Gedemer | 162/353 |
| 3,428,521 | 2/1969 | Roy et al. | 162/366 |
| 3,791,919 | 2/1974 | Schuller et al. | 162/353 |

FOREIGN PATENT DOCUMENTS

| | | | |
|---|---|---|---|
| 2,128,252 | 10/1972 | France | 162/353 |

*Primary Examiner*—Richard V. Fisher
*Attorney, Agent, or Firm*—Peter K. Kontler

[57] ABSTRACT

Apparatus for forming one or more sheets from a dilute suspension of fibers in a liquid has a Fourdrinier wire the upper reach of which travels above a foraminous support, and a head box which has an outlet discharging the suspension onto the upstream portion of the upper reach. The liquid passes through the wire and support, and the fibers form a mat which is carried and advanced by the upper reach of the wire. The apparatus has several deckles which are impervious to liquid and are mounted in or on the support or at a level immediately above the upper reach of the wire. Each deckle extends lengthwise of the entire outlet of the head box and its width is only a small fraction of the width of the outlet. Feed screws or the like are used for moving the deckles sideways so that they overlie selected elongated zones of the upstream portion of the upper reach of the wire, and each deckle can be releasably fixed in the selected position. The deckles can cause the fibers to form a single mat or several parallel mats, depending on the number of deckles and on their positions with respect to the side walls of the head box.

44 Claims, 12 Drawing Figures

MOVABLE DECKLE WITHIN HEADBOX OUTLET

BACKGROUND OF THE INVENTION

The present invention relates to apparatus for making webs or sheets from dilute suspensions of natural, mineral and/or synthetic fibers in liquids, especially to apparatus which can be used in papermaking or analogous machines of the type wherein a fiber slurry is fed onto or against a foraminous screen or wire to leave a thin layer or mat of fibers which can be processed into paper sheets or the like. More particularly, the invention relates to improvements in apparatus of the type wherein the width of the mat can be varied by resorting to devices known as deckles or deckle straps.

U.S. Pat. No. 3,791,919 to Schuller et. al. discloses an apparatus wherein the outlet of the head box is located above the upstream portion of the upper reach of the Fourdrinier wire and the effective width of the outlet can be regulated by two deckle straps which overlie the upper reach of the wire below the outlet and are movable transversely of the direction of lengthwise movement of the upper reach. The arrangement is such that the deckle straps are movable from the marginal portions of the upper reach of the wire toward the central portion of the upper reach to thereby reduce the width of that portion of the wire which allows the liquid (normally water) to pass therethrough. A drawback of such apparatus is that the width of the mat cannot be changed at will, i.e., that the deckle straps cannot overlie relatively large portions of the upper reach of the wire. It has been found that, if the width of the non-overlapped portion of the upper reach of the wire is reduced well below the maximum distance between the marginal portions of the wire, the density of suspension changes at an unpredictable rate. Also, excessive narrowing of the space between the deckle straps entails changes in the cross-sectional area of the mat which deposits on the wire and adversely influences the edges of the mat, i.e., the edges must be subjected to a secondary treatment which contributes to the cost of the ultimate product.

U.S. Pat. No. 1,734,929 to Vedder discloses a papermaking machine which comprises two deckle straps. The deckle straps overlie the upper reach of the Fourdrinier wire and are shiftable laterally of the wire. The width of the outlet for suspension is variable to conform to the desired width of the mat. The deckle straps of Vedder extend well beyond the outlet so that they cannot influence the width of the mat; they merely serve to prevent lateral spreading of fibers which form the mat. The behavior of fibers which are supplied onto the wire of Vedder is basically different from the behavior of fibers in a machine wherein the mat is formed within the confines of the head box, i.e., below the outlet of the device which contains a supply of suspension. The present invention relates to apparatus of the type wherein the mat or mats are formed in the head box.

It was further proposed to improve the configuration of the edges of a mat on a Fourdrinier wire by resorting to jets of a liquid which serves to trim the edges. Such mode of trimming the edges is possible only when the mat is relatively thin and consists of short fibers.

SUMMARY OF THE INVENTION

An object of the invention is to provide a novel and improved apparatus which can change the width of fiber mats on a Fourdrinier wire or an analogous liquid-permeable screen within a wide range and without affecting the quality of the mats.

Another object of the invention is to provide an apparatus which can simultaneously form two or more continuous mats having identical or different widths and consisting of natural, synthetic and/or mineral fibers.

A further object of the invention is to provide an apparatus wherein the means for changing the width of mats is constructed, assembled and mounted in such a way that a change in setup for the purpose of changing the width of mats or webs requires little time and can be carried out by semiskilled or unskilled persons.

An additional object of the invention is to provide novel and improved means which can be used for changing the width of mats of fibrous material in papermaking or analogous machines and which can be installed in existing machines at a reasonable cost.

Still another object of the invention is to provide an apparatus wherein the extent to which the width of fiber mats can be varied is several times the extent of adjustment which is possible in presently known papermaking or analogous machines.

Another object of the invention is to provide an apparatus which can simultaneously produce two or more mats and wherein the edges of the mat or mats need not be trimmed by jets of a liquid or in another way because they are satisfactory irrespective of the length of fibers and/or thickness of the mats.

The invention is embodied in an apparatus for forming sheets from a dilute suspension of fibers in water or another liquid. The apparatus comprises an endless foraminous wire or screen (hereinafter called wire) having an elongated upper reach which moves in a predetermined direction, a head box having an outlet which is disposed above and discharges suspension onto a portion of the upper reach of the wire (preferably at or close to the upstream end of the upper reach), the outlet having a predetermined length and width (as considered, respectively, in and transversely of the direction of movement of the upper reach of the wire), a foraminous support disposed below the upper reach of the wire opposite the outlet to permit the liquid to flow through the wire and the support whereby at least some of the fibers remain on and form a mat which advances with the upper reach of the wire, means for regulating the effective width of the mat including at least one liquid-impermeable deckle extending in the direction of movement of the upper reach of the wire substantially along the full length of the outlet of the head box and having a width which is only a small fraction of the width of the outlet (the deckle may consist of several discrete sections which are sliable in transversely extending recesses or slots of the support, an endless flexible element or an elongated strip which is immediately adjacent to the upper side or under side of the upper reach of the wire, an elongated partition which is articulately connected to a side wall of the head box, or any other component which is capable of preventing the flow of liquid through the wire), means (e.g., feed screws, rods or other types of displacing devices) for moving the deckle sideways to any one of a plurality of different positions in each of which the deckle prevents the flow of liquid through a different elongated zone of the aforementioned portion of the upper reach of the wire, and nuts or other suitable means for maintaining the deckle in the selected position.

The aforementioned side walls of the head box flank the outlet and are preferably parallel or nearly parallel to the deckle.

The apparatus may comprise at least one additional deckle which is spaced apart from and parallel or substantially parallel to the first mentioned deckle, means for moving the additional deckle sideways to any one of a plurality of positions in which the additional deckle prevents the flow of liquid through a different elongated zone of the aforementioned portion of the upper reach of the wire, and means for maintaining the additional deckle in the selected position.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accomanying drawing.

BRIEF DESCRIPTION OF THE DRAWING

FIG. 3A is a schematic longitudinal vertical sectional view of a modification of the apparatus of FIGS. 1 to 3;

DESCRIPTION OF THE PREFERRED EMBODIMENTS

Figure 1:
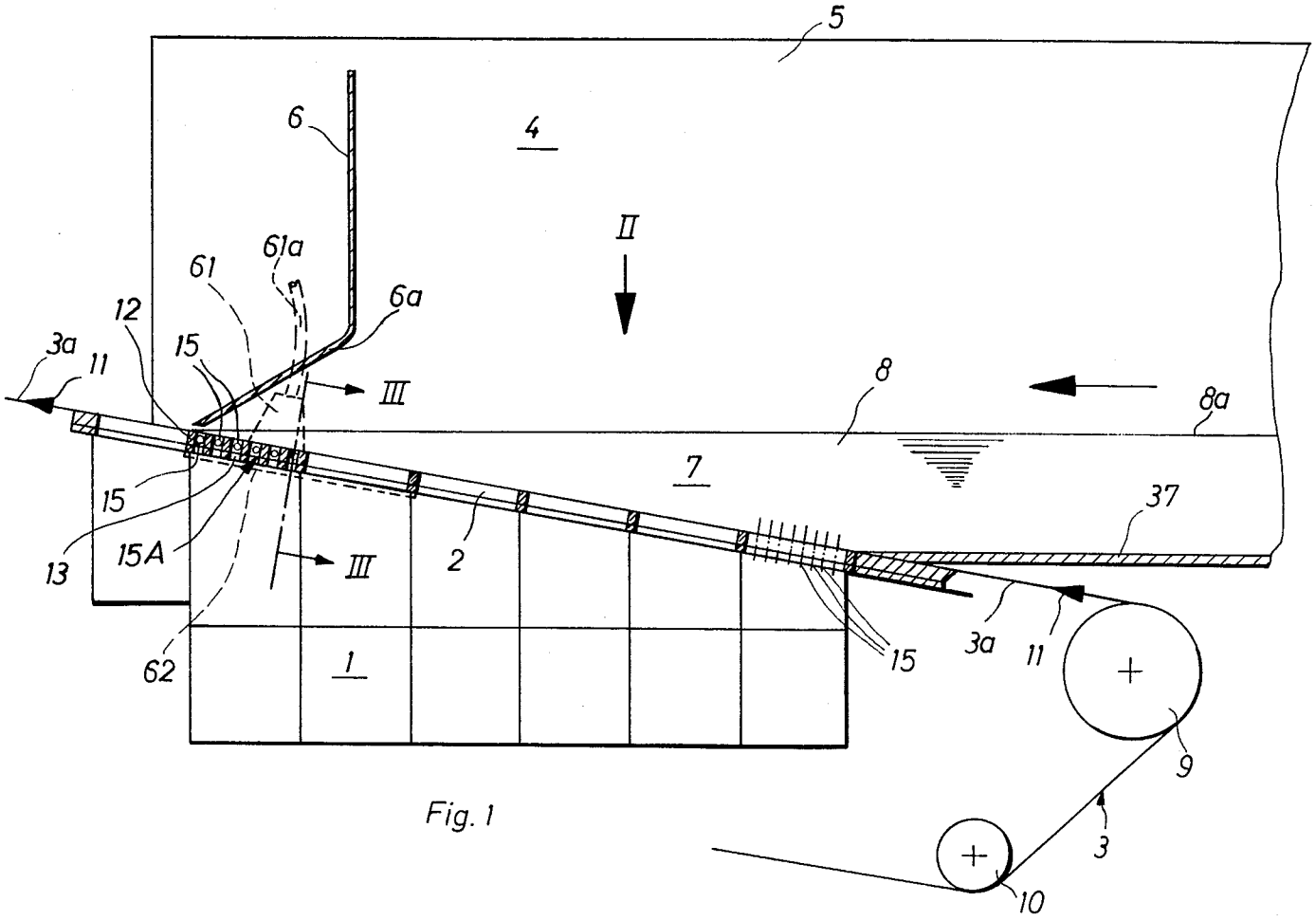
FIG. 1 is a schematic longitudinal vertical sectional view of an apparatus which embodies one form of the invention, the section being taken along the line I—I of FIG. 2 as seen in the direction of arrows.
Figure 2:
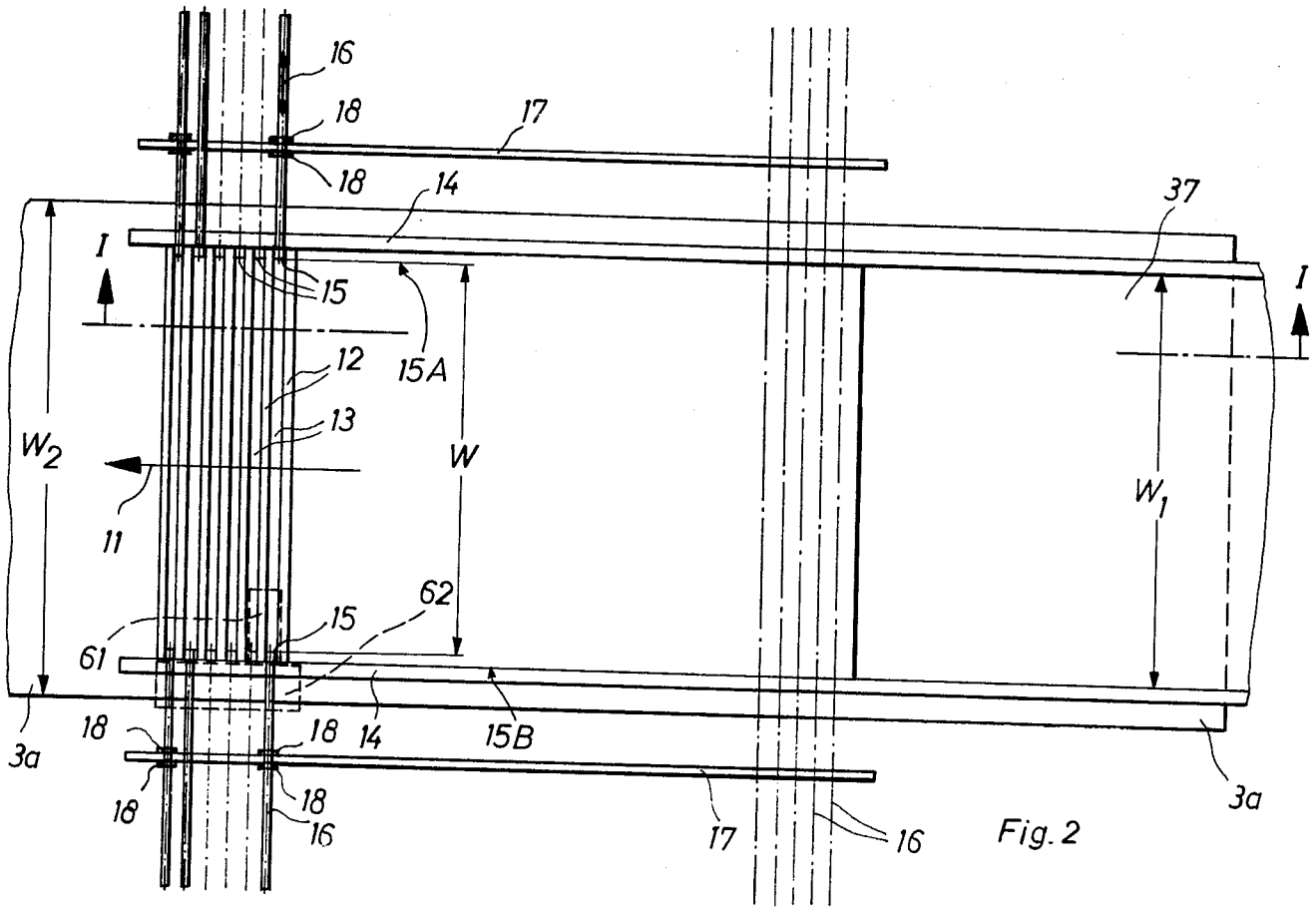
FIG. 2 is a plan view as seen in the direction of arrow II in FIG. 1, with the side walls of the head box omitted.
Figure 3:
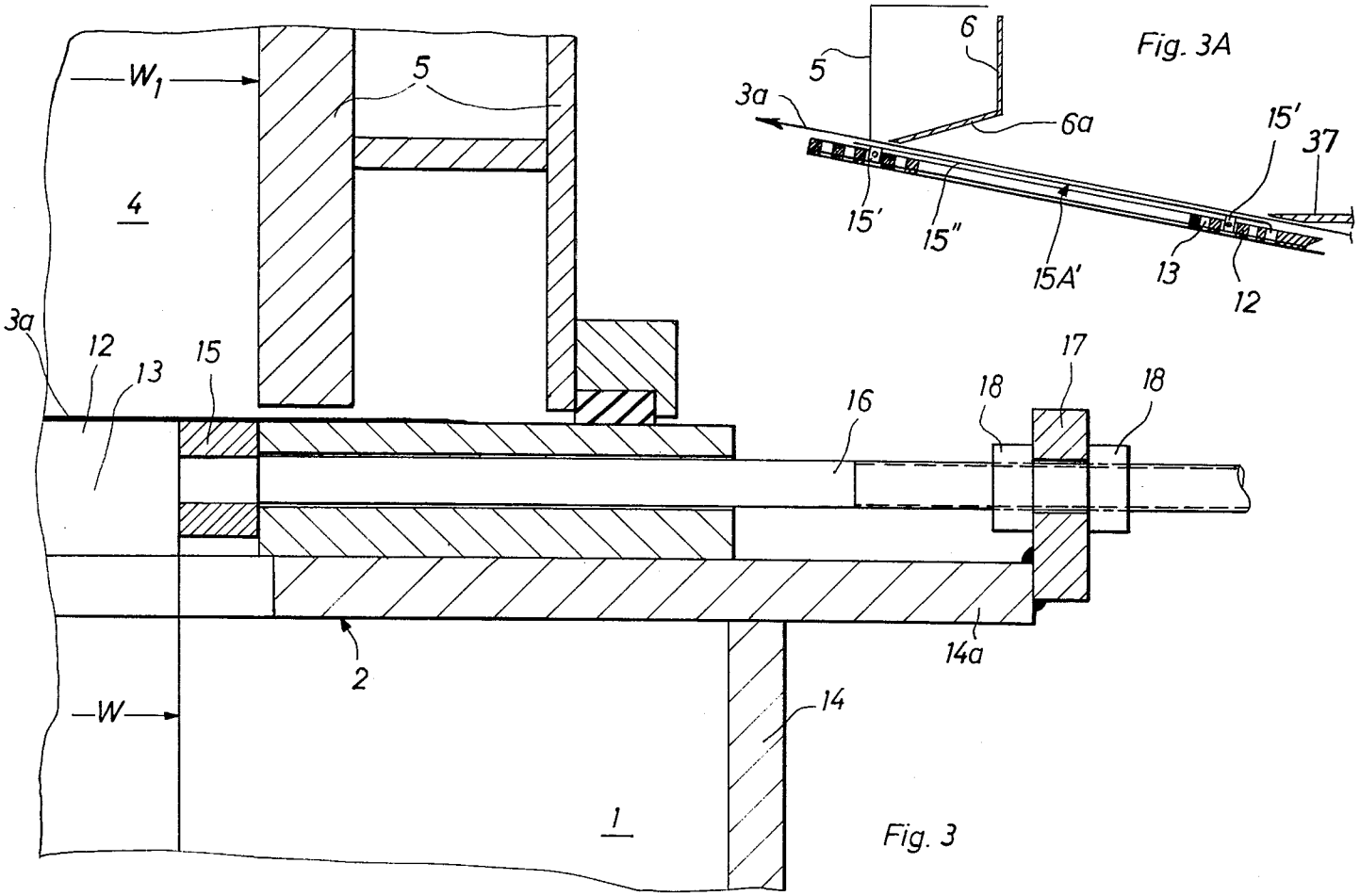
FIG. 3 is an enlarged fragmentary transverse vertical sectional view as seen in the direction of arrows from the line III—III of FIG. 1.
Figure 7:
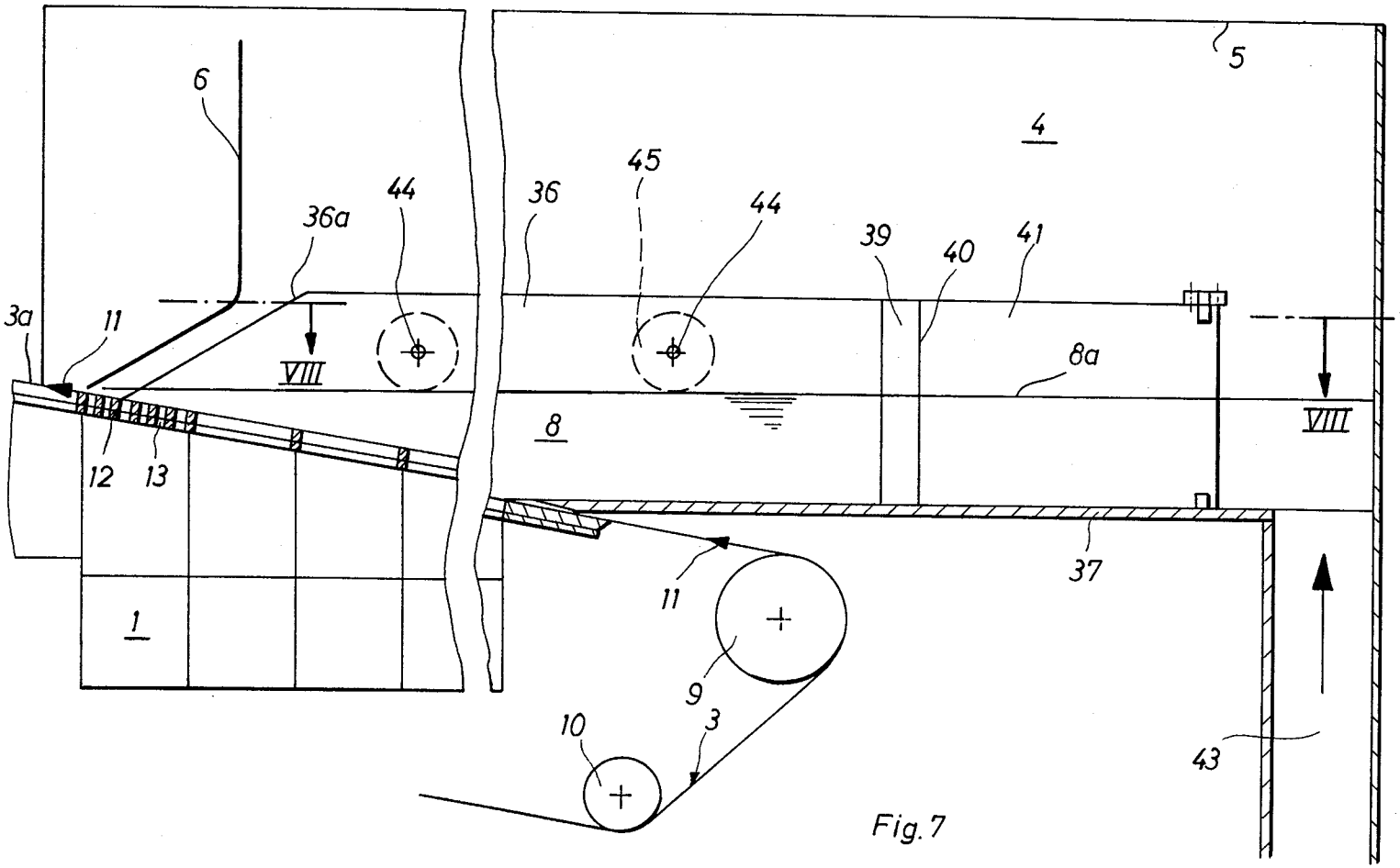
FIG. 7 is a longitudinal vertical sectonal view of a fourth apparatus, substantially as seen in the direction of arrows from the line VII—VII of FIG. 8.
Figure 8:
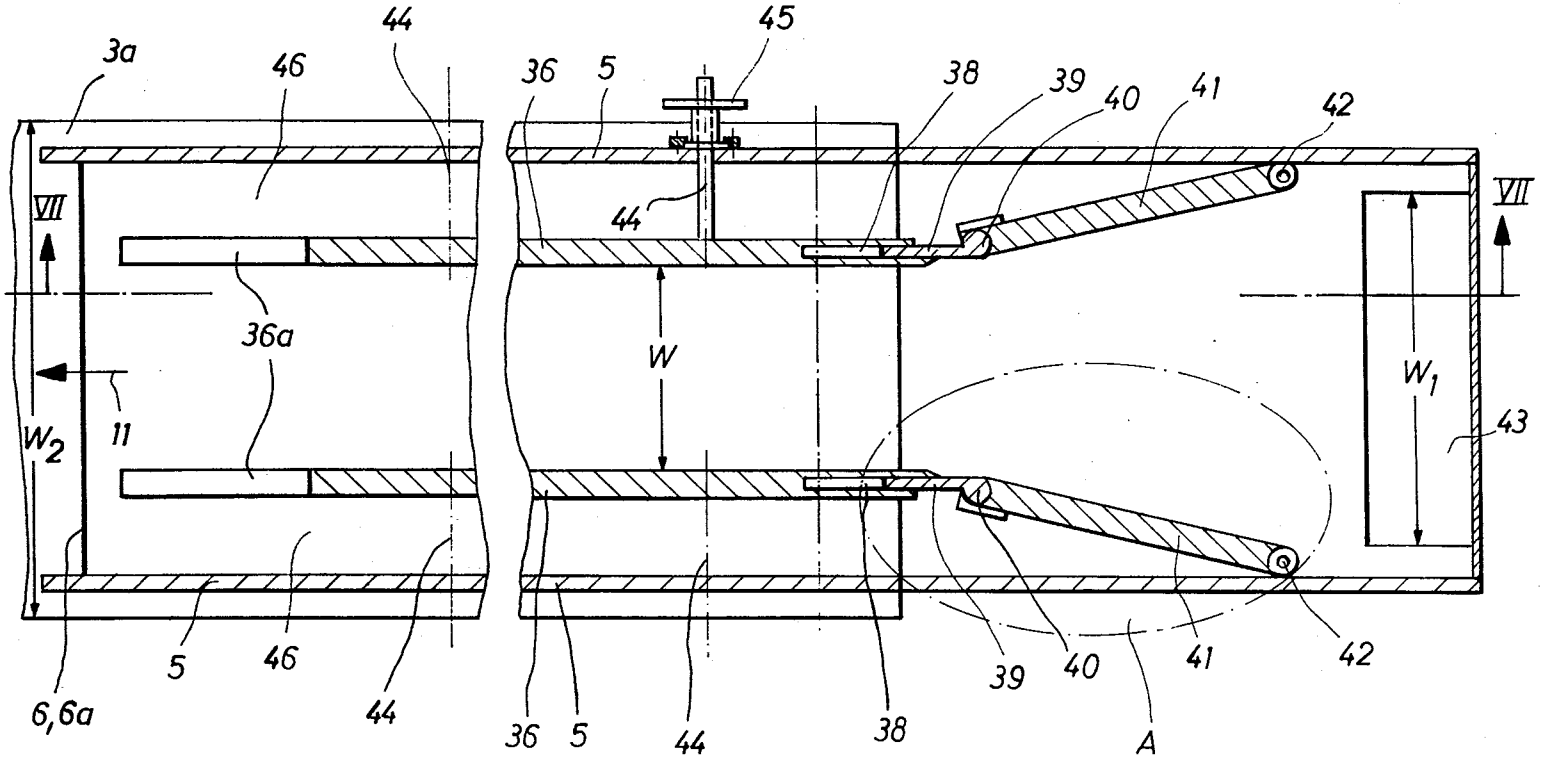
FIG. 8 is a horizontal sectional view as seen in the direction of arrows from the line VIII—VIII of FIG. 7.

Referring first to FIGS. 1 to 3, there is shown an apparatus which comprises an endless foraminous wire or screen 3 which is trained over several rolls including a breast roll 9, a smaller roll 10 upstream of the roll 9 and several additional rolls which are not shown in the drawing. The right-hand portion of the upper reach 3*a* of the wire 3 is located below the relatively long and relatively wide outlet 7 of a head box 4 having two parallel upright side walls 5 (one shown in each of FIGS. 1 and 3) which flank the outlet 7, a front wall 6, a bottom wall 37 behind the outlet and a rear wall, not shown. The upper reach 3*a* of the wire 3 travels immediately above a liquid-permeable support or grate 2 which constitutes the top wall of a series of suction boxes 1. A suspension 8 of fibers in a liquid (e.g., water), which fills the head box 4 to the level 8*a*, may be introduced into the head box from below in a manner as shown in FIGS. 7 and 8. The arrangement is such that the rate of admission of fresh suspension 8 suffices to maintain the level 8*a* while the apparatus forms a continuous mat of fibers which are intercepted by the upper reach 3*a* of the wire 3. The direction of lengthwise movement of the wire 3 is indicated by the arrows 11. The lower portion 6*a* of the front wall 6 of the head box 4 extends forwardly and downwardly toward the adjacent portion of the support 2 to define therewith a wedge-like foremost part of the outlet 7. The gap between the portion 6*a* and the upper side of the upper reach 3*a* is wide enough to permit the mat to advance beyond the front wall 6.

In the embodiment of FIGS. 1 to 3, the permeability of the support 2 is due to the fact that it comprises a plurality of elongated transversely extending narrow strips of ribs 12 which alternate with elongated recesses or slots 13 permitting the liquid to descend into the suction boxes 1 therebelow. The ends of the strips or ribs 12 are rigid with the adjacent side walls or frame members 14 of the support 2 and suction boxes 1; these frame members extend in parallelism with and are located below the respective side walls 5 of the head box 4.

Each of the slots 13 receives two spaced-apart blocks 15 which are impervious to liquids and are received between the neighboring ribs 12 with a minimum of clearance so as to prevent the flow of liquid through the adjacent (overlying) portion of the upper reach 3*a*. The blocks 15 which are adjacent to one of the frame members 14 form sections of a first elongated deckle 15A which extends substantially along the full length of the outlet 7 of the head box 4 and is (but need not be) parallel to the side walls 5. The blocks 15 which are adjacent to the other frame member 14 constitute the sections of a second elongated deckle 15B which is (but need not be) parallel to the deckle 15A and hence to the side walls 5. Each of the deckles 15A, 15B prevents the liquid from flowing through a relatively narrow elongated zone of the upper reach 3*a* below the outlet 7 of the head box 4. As shown in FIGS. 2 and 3, the width of each deckle is only a small fraction of the width $W_2$ of the wire 3 and/or the width $W_1$ of the outlet 7.

Each section or block 15 is mounted on the inner end of a discrete displacing member 16 here shown as a horizontal feed screw which extends outwardly through the adjacent frame member 14 and through the registering hole of an elongated guide rail 17 which is welded or otherwise affixed to a lateral extension 14*a* of the respective frame member 14. The blocks 15 share all axial movements of the corresponding feed screws 16 but need not rotate therewith (if the feed screws are rotatable). By shifting the feed screws 16 at one side of the outlet 7 axially, the attendants can move the respective deckle 15A or 15B toward or away from the other deckle, i.e., nearer to or further away from the respective frame member 14 and side wall 5. The means for maintaining the deckle 15A or 15B in a selected position comprises pairs of nuts 18 which mate with the corresponding feed screws 16 and flank the associated guide rail 17. If desired or necessary, at least one set of feed screws 16 can carry two or more spaced-apart blocks 15 each of which constitutes a section of a discrete deckle. The feed screws 16 are parallel with the ribs 12 and extend at right angles to the directions (arrows 11) of lengthwise movement of the upper reach 3*a* of the wire 3. If desired, the feed screws 16 can be replaced by rods which are slidable in the rails 17 and can be held in selected positions by friction or by resorting to suitable clamps, not shown.

Each of the two illustrated deckles 15A, 15B prevents the development of a mat on the adjacent elongated zone of the upper reach 3*a* because these deckles prevent the flow of liquid through such zones and into the suction boxes 1 therebelow. FIG. 2 shows the deckles 15A, 15B in their outermost positions in which the width W of the mat which is formed on the upper reach 3*a* between the deckles is only (but need not be) slightly less than the width $W_1$ of the outlet 7. The width $W_1$ is somewhat less than the width $W_2$ of the upper reach 3*a*. In such outermost positions of the deckles 15A, 15B, the outer end faces of the blocks 15 lie flush against the inner sides of the respective frame members 14 (see particularly FIG. 3).

If the deckles 15A, 15B are shifted toward the center of the outlet 7, the fibers which are intercepted by the upper reach 3*a* form three mats, one between the deckles 15A, 15B, another between the deckle 15A and the adjacent frame member 14, and a third between the deckle 15B and the other frame member 14. As a rule, the two outer mats are relatively narrow and their fibers are preferably reintroduced into the suspension which is about to enter the head box 4. The separation of outer mats from the median mat presents no problems because the fibers which overlie the deckles 15A, 15B cannot establish a firm connection between the median mat and the outer mats. The separation can take place immediately downstream of the outlet 7. The inability of fibers (if any) which overlie the deckles to form a firm bond between the outer mats and the median mat is attributable to the absence of pressure differential between the regions above and below the deckles. The material which deposits on those zones of the wire 3 which overlie the deckles merely forms a loose layer of fibers.

It has been found that, in most instances, no deposition of fibers takes place in those zones of the upper side of the upper reach 3*a* which overlie the deckles 15A and 15B. This is desirable and advantageous because the edges of the mat or mats which are formed on the wire 3 are quite pronounced and need not be subjected to a secondary treatment. The absence of deposition of fibers in the aforementioned zones of the upper side of the upper reach 3*a* is attributable, at least to a certain degree, to the fact that the width of each deckle is only a very small fraction (e.g., less than five percent) of the width of the outlet 7.

It is not necessary that all blocks or sections 15 of the deckle 15A and/or 15B form a straight row. For example, the blocks 15 of each deckle may be arrayed in the form of several rows which are offset with respect to each other (i.e., which are disposed at different distances from the respective frame members 14) so as to account for a particular pattern of separation of fibers from the liquid carrier. Moreover, such distribution of blocks 15 in one or both deckles can influence the cross-section and/or density of the mat which is formed between the deckles. It is further possible to stagger all or nearly all blocks 15 of the deckle 15A and/or 15B; such deckles will still prevent the flow of liquid through relatively narrow zones of the upper reach 3*a* below the outlet 7, and such narrow zones will extend substantially longitudinally of the wire 3.

It will be appreciated that the entire support 2 is formed with alternating transversely extending slots 13 and ribs 12. For the sake of simplicity, the FIGS. 1 and 2 show such formations only at the front and rear ends of the outlet 7.

The fibers which deposit on the upper reach 3*a* between the deckles 15A, 15B and the respective frame members 14 can be continuously collected before they advance beyond the front wall 6 of the head box 4 or immediately downstream of the portion 6*a*. The thus removed fibers can be returned directly into the head box 4 or into the means which feeds solution 8 to the head box. FIGS. 1 and 2 show one or two suction heads 61 which can be used for collection of fibers that deposit on the upper reach 3*a* at the outer sides of the deckles 15A, 15B when the deckles are moved inwardly and away from the respective frame members 14 so that the suspension can flow through those portions of the upper reach 3*a* and slots 12 which flank the deckles 15A and 15B. The suction heads 61 are preferably mounted at the forward end of the outlet 7 in the interior of the head box 4 and are connected with suction generating means by conduits 61*a*. It is desirable to provide the apparatus with suction heads whose width, as considered transversely of the wire 3, can be varied in order to insure that the width of suction heads changes at the same rate as the width of spaces (if any) between the deckles 15A, 15B and the respective frame members 14.

FIG. 1 further shows (by broken lines) a baffle 62 or an analogous intercepting or sealing device which is mounted below the support 2 and is movable toward and away from the center of the outlet 7 so that it lies below the spaces (if any) between the deckles 15A, 15B and the respective frame members 14 opposite the corresponding suction head 61. The purpose of the baffles 62 is to prevent suction in the adjacent boxes 1 from causing a flow of liquid through the aformentioned spaces below the suction heads 61. Thus, those increments of the upper reach 3*a* which advance forwardly beyond the front wall 6 of the head box 4 carry a single mat which consists of fibers that were intecepted by the wire 3 in the space between the deckles 15A and 15B. In the absence of suction heads 61, the fibers which accumulate on the upper reach 3*a* between the deckles 15A, 15B and the respective frame members 14 would have to be removed downstream of the front wall 6 by a special intercepting device (couch pit) which would return such fibers into means for feeding the suspension 8 into the head box 4.

A single suction head 61 suffices if the apparatus comprises a single deckle or if only one of the deckles is movable away from the respective frame member 14. As a rule, the apparatus of FIGS. 1–3 will be equipped with two suction heads 61.

In the modification of FIG. 3A, each deckle (only the deckle 15A′ is shown) includes only a few, e.g., two, blocks 15′ which are connected by a band or strip 15″ located above the ribs 12. The band or strip 15″ of each deckle extends substantially along the full length of the outlet 7 of the head box 4 and has a very small width as compared to the width of the outlet 7. The bands or strips 15″ replace the plurality of blocks 15, i.e. only one band or strip 15″ and only two blocks 15′ are necessary for each deckle.

The apparatus of FIGS. 1 to 3 is susceptible of many additional modifications which will be readily understood without illustration. For example, the guide rails 17 need not be affixed to the adjacent frame members 14; instead, such guide rails can be mounted for movement with the respective sets of feed screws 16, i.e., transversely of the upper reach 3*a* of the wire 3. Such mounting of the guide rails 17 simplifies the adjustment of blocks 15, i.e., all blocks of a deckle can be shifted as a unit lengthwise of the respective slots 13 by the simple expedient of moving the respective rail 17 toward or away from the adjacent frame member 14.

In accordance with another modification, groups of two or more blocks 15 in at least one of the deckles 15A, 15B can be mounted for simultaneous movement transversely of the upper reach 3*a*. Furthermore, each block 15 of one deckle can be coupled to a block of the other deckle so that any movement of one of the deckles transversely of the upper reach 3*a* entails a similar movement of the other deckle. Alternatively, the connections between the blocks 15 of the deckle 15A and the blocks 15 of the deckle 15B may be such that the movement of deckle 15A toward the center of the outlet 7 entails a similar movement of the deckle 15B, i.e., also toward the center of the outlet. The connections between the blocks of one deckle and the blocks of the other deckle can be disposed above and/or below the support 2. Still further, it is possible to connect groups of blocks 15 which form the deckle 15A with aligned groups of blocks 15 which form the deckle 15B.

An important advantage of the improved apparatus is that the machine which incorporates such apparatus can be used for the making of a single mat or two or more mats at a time. The mats may but need not be of identical width, i.e., the deckles 15A, 15B can be adjusted in such a way that (a) the machine forms a single mat between the deckles 15A, 15B, (b) a pair of mats one of which is formed between the deckles 15A, 15B and the other of which is formed between the deckle 15A or 15B and the respective frame member 14, or (c) three mats including a first or central mat between the deckles 15A, 15B, a second (outer) mat between the deckle 15A and the adjacent frame member 14, and a third (outer) mat between the deckle 15B and the other frame member 14. The width of the outer mat or mats can exceed or is less than the width of the central mat.

Another advantage of the improved apparatus is that it prevents the development of so-called dead zones which develop above the upper reaches of wires (in the head boxes) of conventional sheet forming apparatus.

Figure 4:
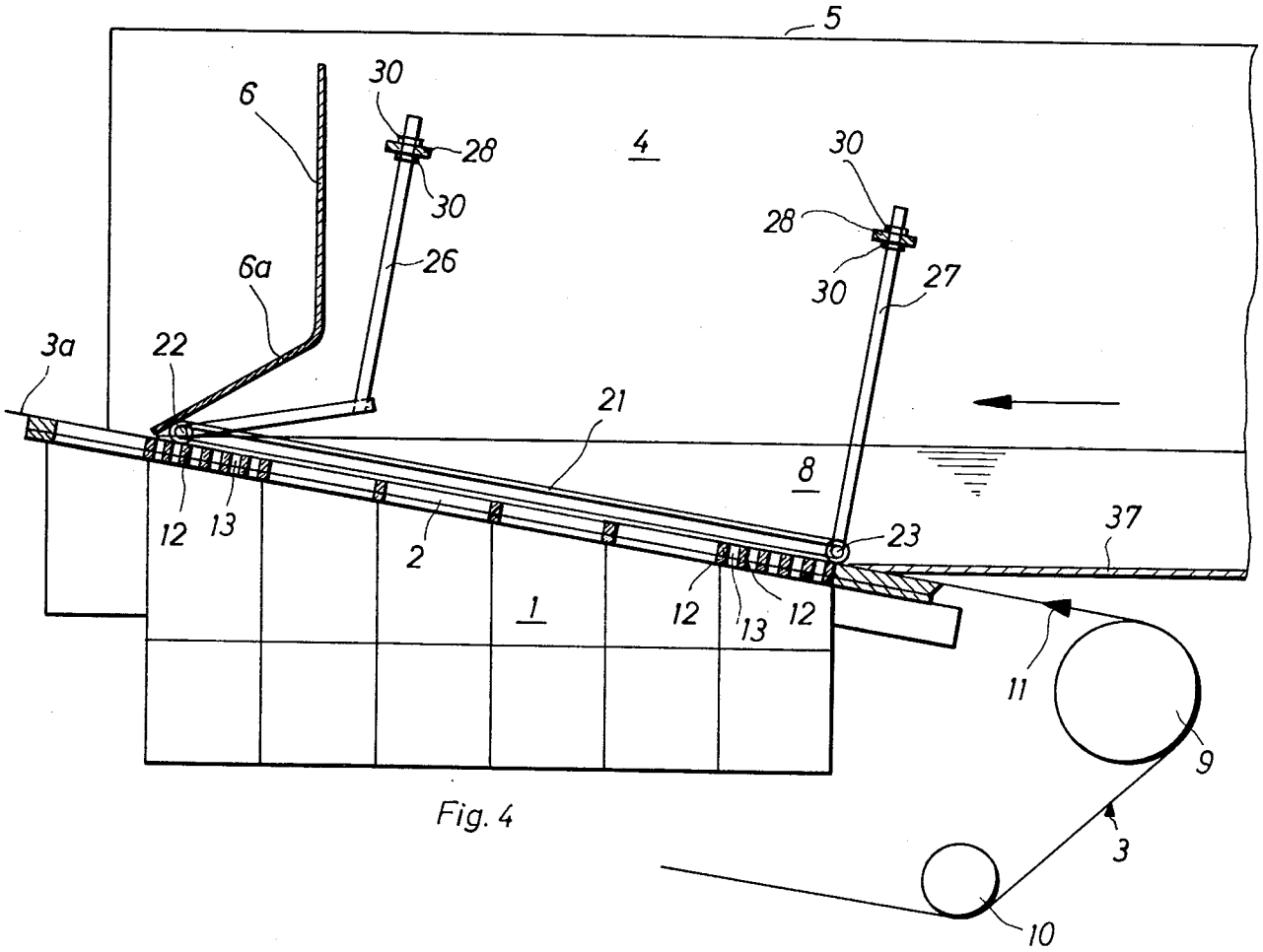
FIG. 4 is a longitudinal vertical sectional view of a second apparatus, substantially as seen in the direction of arrows from the line IV—IV of FIG. 5.
Figure 5:
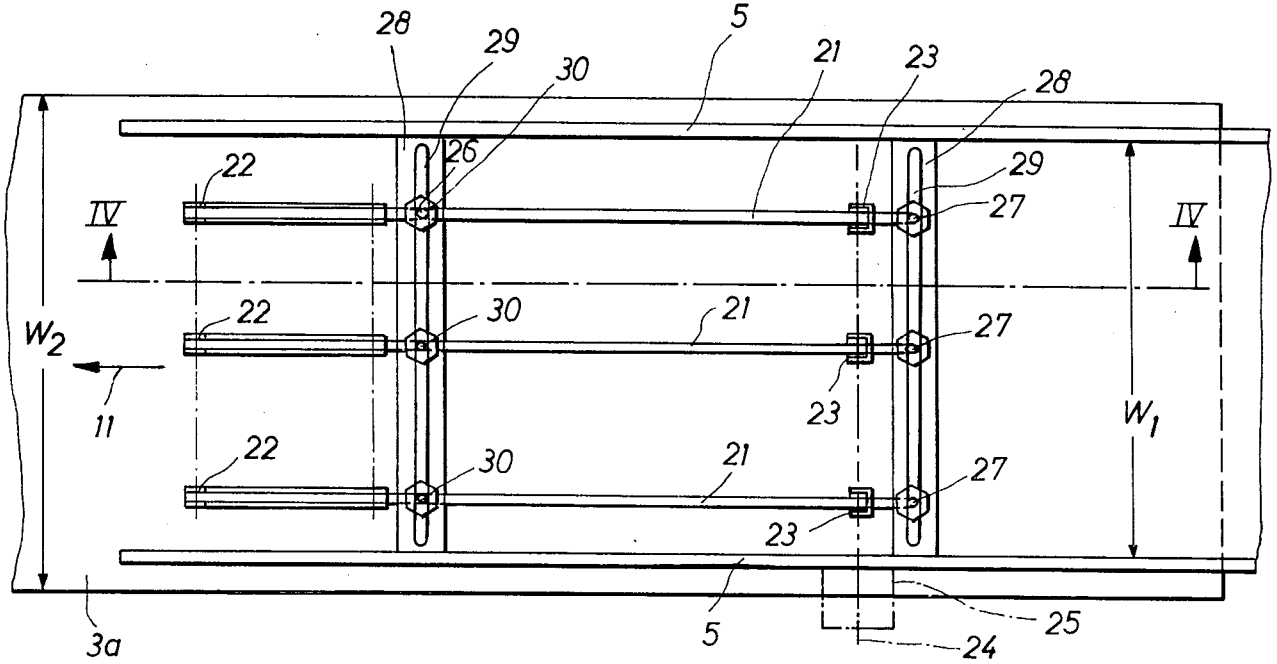
FIG. 5 is a plan view of the second apparatus, with the head box omitted.

Referring now to FIGS. 4 and 5, there is shown a second apparatus with three deckles 21 each of which constitutes an endless flexible element, preferably a narrow belt, which consists of impervious material. All such parts of the second apparatus which are identical with or clearly analogous to the corresponding parts of the apparatus shown in FIGS. 1 to 3 are denoted by similar reference characters.

The deckles 21 are located at a level immediately above the upper side of the upper reach 3*a*, i.e., they are disposed above the support 2 which may be identical with the support of FIGS. 1–3 (see the slots 13 and ribs 12 in FIG. 4). The number of deckles can be reduced to two or more, or increases to four or more.

Each deckle 21 is trained over two rotary members (e.g., wheels or rolls) including a front rotary member 22 and a rear rotary member 23. The shafts for the rotary members 22, 23 are parallel to the upper reach 3*a* of the wire 3 and extend at right angles to the direction of lengthwise movement of the wire (see the arrows 11). Each rotary member 22, as well as each rotary member 23, may be an idler roll or wheel. Alternatively, and as indicated in FIG. 5 by phantom lines, the rear rotary members 23 may be mounted on and be rotatable with a transverse horizontal shaft 24 which is driven by a suitable prime mover 25, e.g., an electric motor. The lower reaches of the deckles 21 then move in the direction indicated by arrows 11, i.e., in the direction of lengthwise movement of the upper reach 3*a*. If the rotary members 22, 23 are idler rolls or wheels, the endless flexible deckles 21 receive motion from the upper reach 3*a* of the wire 3. It is clear that, if driven by the motor 25, the rolls 23 must be free to move axially of the shaft 24 so as to allow for sidewise movement of each deckle 21 between a plurality of positions transversely of the wire 3, i.e., in the longitudinal direction of slots 13 and ribs 12.

The rotary members 22 and 23 are mounted on the lower portions of discrete elongated carriers 26 and 27 the upper portions of which are formed with external threads and extend through elongated slots 29 of transversely extending guide rails 28 which are affixed to the side walls 5 of the head box 4. The means for maintaining the deckles 21 in selected positions (i.e., at a selected distance from each other and from the side walls 5) includes pairs of nuts 30. By loosening the upper and/or lower nuts 30, the attendants can shift the respective deckles 21 sideways.

The upper portions of the carriers 26, 27 can be coupled to feed screws adapted to move the deckles 21 in a manner as shown for the deckles 15A, 15B of FIGS. 1–3.

Figure 6:
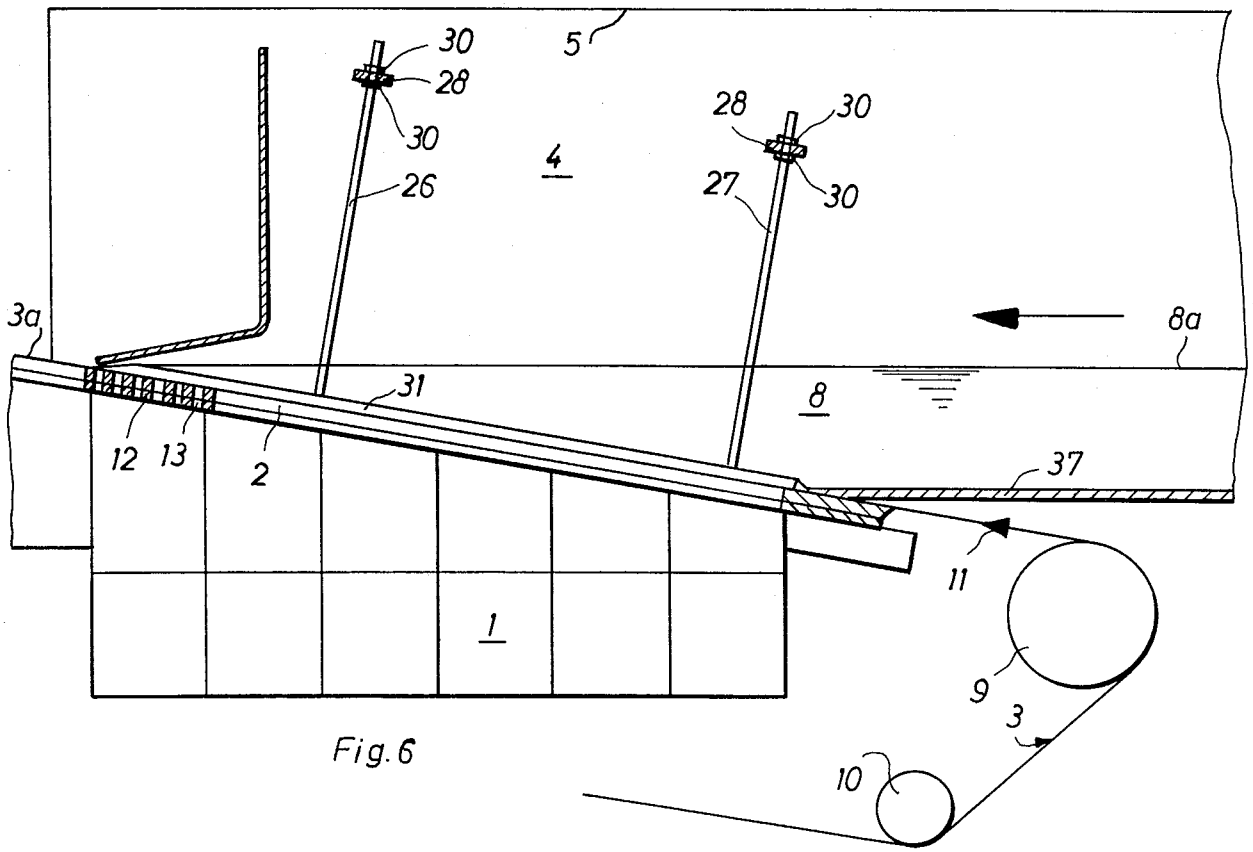
FIG. 6 is a longitudinal vertical sectional view of a third apparatus.

FIG. 6 shows an apparatus which constitutes a slight modification of the apparatus of FIGS. 4 and 5. The endless flexible deckles 21 are replaced with one or more elongated rigid strip-shaped deckles 31 each of which is mounted on the lower portions of two carriers 26, 27 corresponding to the similarly numbered carriers of FIGS. 4 and 5. The underside of each deckle 31 can rest on the upper surface of the upper reach 3*a* of the wire 3, and each such deckle 31 may consist of wood, metal, synthetic plastic material, another relatively rigid and impermeable material or a combination of two or more different materials.

FIGS. 7 and 8 show another apparatus wherein each of the two deckles 36 is an elongated upright partition of wall having a forwardly and downwardly sloping front edge face 36*a* and extending in parallelism with the side walls 5 of the head box 4. The planes of the partitions 36 are normal to the plane of the adjacent portion of the upper reach 3*a* and the rear edge faces of these partitions are formed with narrow upright sockets 38 for forwardly extending complementary plate-like male members 39 the rear end portions 40 of which are substantially cylindrical and can turn in complementary concave sockets at the front ends of plate-like guides 41. The rear end portions of the guides 41 are articulately connected with the respective side walls 5 by upright hinges 42. The deckles 36 have lower edge faces the front portions of which are immediately adjacent to or abut against the upper side of the upper reach 3*a* and the rear portions of which abut against the upper side of the bottom wall 37.

The means for moving the deckles 36 sideways comprises pairs of feed screws 44 having inner portions which are rotatably mounted in the respective deckles and outer portions which mates with the internal threads of wheels 45 or analogous rotary members (e.g., nuts) rotatably mounted at the outer sides of the respective side walls 5. Thus, by rotating the wheels 45 at the selective side of the head box 4, an attendant can move the corresponding deckle 36 toward or away from the other deckle. At the same time, the corresponding male member 39 extends deeper into the slides outwardly in the respective socket 38. The depth of each socket 38 is sufficient to insure that the deckles 36 can be moved into substantial parallelism with the respective guides 41, i.e., into close or immediate proximity to the inner sides of the corresponding side walls 5. The number of feed screws 44 and wheels 45 for each deckle 36 can be reduced to one or increased to three or more. Each such feed screw is slidable in a hole of the corresponding side wall 5. A single feed screw 44 for each deckle 36 suffices because the guides 41 insure that the deckles move sideways in response to rotation of the corresponding wheels 45, i.e., that the deckles 36 remain parallel to each other and to the side walls 5. The sockets 38 and plates 39 insure that the deckles 36 need not move forwardly or backwards in response to rotation of the corresponding wheels 45.

Figure 9:
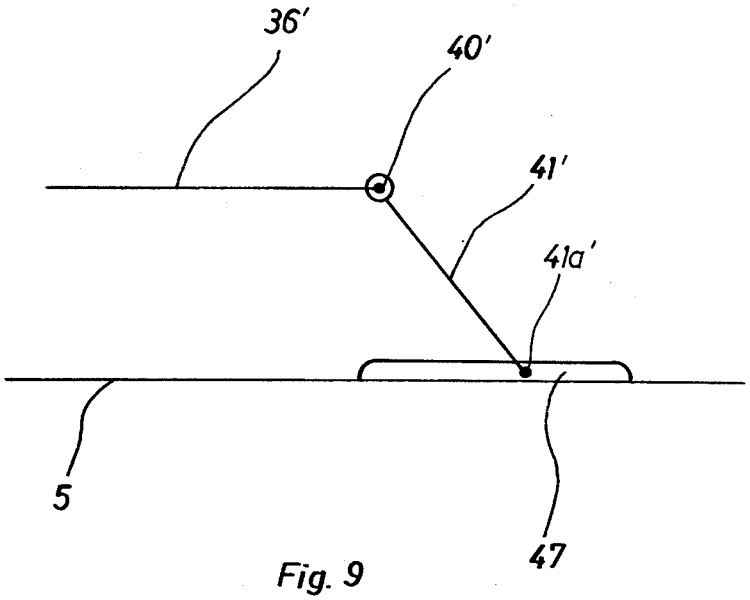
FIG. 9 is a fragmentary schematic plan view of a first modification of the apparatus of FIGS. 7 and 8, the modified structure replacing the structure within the area bounded by the phantom line A shown in FIG. 8.

FIG. 9 shows a first modification of the means for guiding the rear portions of the deckles 36. The rear portion of the deckle 36' of FIG. 9 is formed with an upright cylindrical portion 40' which is received in a complementary concave socket at the front edge of an upright plate-like guide 41' the rear edge of which has a follower **41*a*' slidable in a vertical slot 47 of the corresponding side wall 5. When the deckle 36' is moved toward or away from the side wall 5, the angular position of the guide 41' changes because the follower 41*a*' slides in the slot 47. The follower 41*a*' may be a pin, a wheel or the like. The part 40' may constitute a simple upright hinge between the deckle 36' and the guide 41'**.

Figure 10:
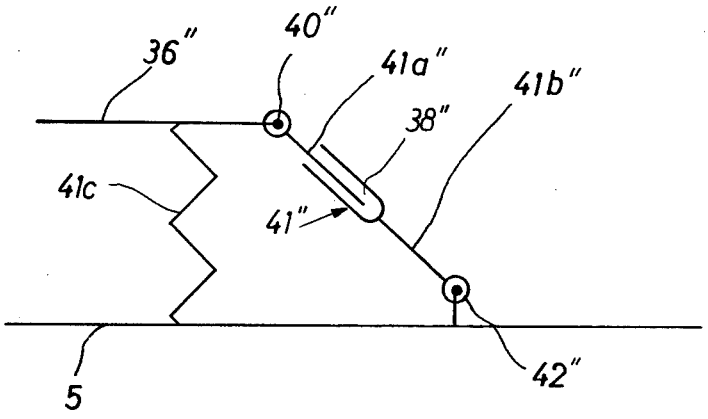
FIG. 10 is a fragmentary plan view of a second modification of the apparatus of FIGS. 7 and 8.

FIG. 10 shows a second modification of means for guiding the rear edges of the deckles 36" (one shown) which correspond to the deckles 36 of FIGS. 7 and 8. The rear portion 40" of the deckle 36" is analogous to the portion 40' of FIG. 9 and is received in the front part **41*a*" of a two-piece guide 41". The latter further comprises a rear part 41*b*" having a socket 38" for the rear portion of the part 41*a*". When the partition or deckle 36" moves toward or away from the adjacent side wall 5, the part 41*a*" slides in the socket 38" of the rear part 41*b*" of the guide 41". The positions of the parts 41*a*", 41*b*" can be reversed, i.e., the part 41*b*" can be articulately coupled to the rear edge of the deckle 36" and the part 41*a*" is then articulately connected with the side wall 5 by a hinge 42"** or the like.

The means for articulately coupling the rear portions of partitions 36 to the respective side walls 5 may include suitable bellows **41*c* or any other coupling means which allow the partitions to move sideways but prevent entry of suspension into the compartments 46** between the partitions and the corresponding side walls.

Figure 11B:
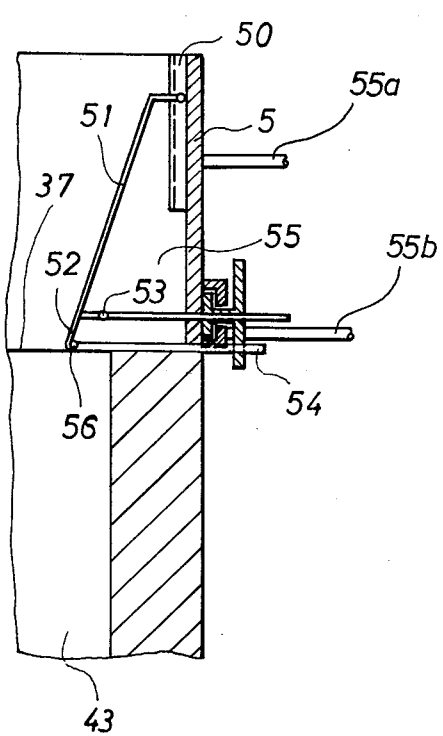
FIG. 11B is a fragmentary transverse vertical sectional view of a further apparatus which constitutes a modification of the apparatus of FIG. 11A.
Figure 11A:
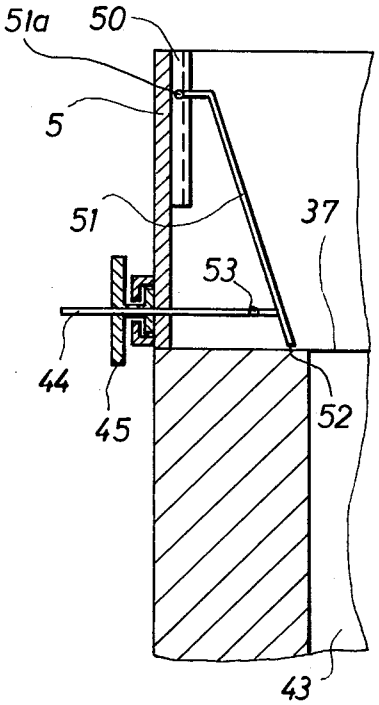
FIG. 11A is a fragmentary transverse vertical sectional view of still another apparatus.

FIG. 11A shows a further modification. The deckle 51 is a plate-like body the upper portion of which has one or more followers **51*a* movable in vertical ways 50 at the inner side of the respective side wall 5. The lower edge face of the deckle 51 abuts against the upper reach of the wire 3 (not shown in FIG. 11A) and against the upper side of the bottom wall 37 of the head box. The reference character 43 denotes a channel which feeds the suspension 8** into the head box.

The means for moving the deckle 51 sideways comprises one or more feed screws 44 which can be moved axially in response to rotation of mating wheels 45 mounted at the outer side of the respective side wall 5. The inner end portion of each feed screw 44 is articulately connected to the deckle 51, as at 53. Each part 53 is a pivot which is parallel to the direction of lengthwise movement of the upper reach of the wire, i.e., parallel to the lower edge portion 52 of the deckle.

FIG. 11B shows a modification of the structure of FIG. 11A. The lower edge portion 52 of the deckle 51 (which corresponds to the deckle 51 of FIG. 11A) is movable toward the center of the outlet of the head box to such an extent that its rear part is located above the channel 43 for admission of fresh suspension. In order to prevent the suspension from entering the compartment 55 between the deckle 51 and the adjacent side wall 5 of the head box, the appartus of FIG. 11B further comprises a plate-like baffle or shield 54 which is articulately connected to the lower edge portion 52, as at 56, and slides along the upper side of the bottom wall 37 so that it seals the compartment 55 from the channel 43 when the deckle 51 of FIG. 11B assumes the illustrated position.

If desired, the compartment 55 can communicate with a first pipe **55*a* for admission of a liquid (e.g., water) and a second pipe 55*b* for evacuation of admitted liquid. The liquid is circulated through the compartment 55 by resorting to a suitable pump or the like. Such liquid prevents the penetration of suspension into the compartment 55** and immediately evacuates fibers which happen to penetrate into the compartment.

The baffle 54 extends laterally from the head box, i.e., outwardly and beyond the respective side wall 5. Therefore, the feed screw 44 and the wheel or wheels 45 can be omitted (even though they are shown in FIG. 11B) because the deckle 51 can be moved sideways by means of the baffle 54. Means may be provided for releasably fixing the baffle 54 (and hence the deckle 51) in any one of several positions.

Baffles of the type shown at 54 in FIG. 11B can be used with equal advantage in the apparatus of FIGS. 7 and 8. Thus, the lower edge portion of each plate-like deckle 36 can be connected with a baffle (not shown) which extends outwardly toward and through a suitable slot in the respective side wall 5. Such baffles allow for admission of a liquid into the compartments 46 between the deckles 36 and the respective side wall 5 whereby the admitted liquid prevents the penetration of suspension into the compartments 46. The baffles for the compartments 46 can be configurated and/or mounted in such a way that they allow for gradual escape of admitted liquid, either into the suction boxes 1 therebelow or into the space between the deckles 36. This can be achieved by resorting to suitable flow restrictor means. The baffles for the deckles 36 of FIGS. 7 and 8 can be installed at a level above or below the upper reach **3*a* of the wire 3**.

The width of a deckle 15A, 15B, 15A', 21 or 31, and preferably also of a deckle 36 or 51, should be as small as possible but not smaller than the length of the longest fibers of the suspension.

The width of a deckle 36 or 51 is selected in such a way that the deckle cannot be deflected by the suspension in the head box 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. Apparatus for forming sheets from a dilute suspension of fibers in a liquid, comprising an endless wire having an elongated reach which moves in a predetermined direction; a head box having a suspension-discharging outlet disposed above a portion of said reach and having a predetermined length and width, as considered respectively in and transversely of said direction, said head box including two side walls flanking said outlet; a foraminous support disposed below said reach opposite said outlet to permit the liquid to flow through said wire and said support whereby at least some fibers remain on and form a mat which advances with said reach in said direction; means for regulating the effective width of said mat including a deckle extending in said direction substantially along the full length of said outlet and having a width which is a small fraction of the width of said outlet; and means for moving said deckle sideways to any one of a plurality of positions in each of which said deckle prevents the liquid from flowing through a different elongated zone of said reach, said positions including at least one position in which said deckle is spaced apart from each of said side walls.

2. Apparatus as defined in claim 1, wherein said side walls extend in substantial parallelism with said deckle.

3. Apparatus as defined in claim 1, further comprising means for maintaining said deckle in the selected position.

4. Apparatus as defined in claim 1, wherein said regulating means comprises at least one additional deckle which is substantially parallel to said first mentioned deckle and means for moving said additional deckle sideways to any one of a plurality of positions in each of which said additional deckle prevents the flow of liquid through a different zone of said portion of said reach of said wire, the width of said additional deckle being a small fraction of the width of said outlet.

5. Apparatus as defined in claim 4, further comprising means for maintaining said additional deckle in the selected position.

6. Apparatus as defined in claim 4, wherein said deckles are spaced apart from each other.

7. Apparatus as defined in claim 1, wherein said deckle is located at a level below said reach of said wire.

8. Apparatus as defined in claim 1, wherein said deckle is located within the confines of said foraminous support.

9. Apparatus as defined in claim 8, wherein said support has a plurality of elongated recesses extending substantially transversely of said direction and said deckle comprises a plurality of sections receives in and movable lengthwise of the respective recesses.

10. Apparatus as defined in claim 1, wherein said means for moving said deckle comprises at least one displacing device extending outwardly beyond one of said side walls.

11. Apparatus as defined in claim 10, wherein said displacing device includes a feed screw.

12. Apparatus as defined in claim 10, wherein said displacing device includes a rod.

13. Apparatus as defined in claim 1, wherein said deckle is located at a level above said support.

14. Apparatus as defined in claim 13, wherein said deckle is located immediately above said reach of said wire.

15. Apparatus as defined in claim 14, wherein said deckle is an elongated strip-shaped member.

16. Apparatus as defined in claim 14, wherein said deckle is an endless flexible element.

17. Apparatus as defined in claim 16, wherein said flexible element has a lower reach which is immediately adjacent said portion of said reach of said wire, said moving means comprising at least two rotary members having axes extending transversely of said direction and said flexible element being trained over said rotary members.

18. Apparatus as defined in claim 17, wherein said rotary members are idler wheels.

19. Apparatus as defined in claim 17, further comprising means for rotating at least one of said rotary members so as to advance said lower reach in said direction.

20. Apparatus as defined in claim 14, wherein said deckle includes an elongated partition extending upwardly from said reach of said wire and one of said side walls defines with said partition a compartment which overlies a predetermined area of said portion of said reach of said wire and is at least substantially sealed against entry of suspension.

21. Apparatus as defined in claim 1, wherein said means for moving said deckle includes at least one carrier having a lower portion supporting said deckle and an upper portion, said guide means for said upper portion, said guide means extending substantially transversely of said wire and said upper portion of said carrier being movable along said guide means.

22. Apparatus as defined in claim 21, wherein said guide means includes a rail having an elongated slot for said upper portion of said carrier.

23. Apparatus as defined in claim 21, wherein said guide means includes a feed screw.

24. Apparatus as defined in claim 1, wherein said head box includes a bottom wall located rearwardly of said outlet, as considered in said direction, and said deckle has a front portion located above said portion of said reach of said wire and a rear portion overlying said bottom wall.

25. Apparatus as defined in claim 1, further comprising means for collecting fibers which deposit on said portion of said reach of said wire between said one of said side walls and deckle in said one position of said deckle.

26. Apparatus for forming sheets from a dilute suspension of fibers in a liquid, comprising an endless wire having an elongated reach which moves in a predetermined direction; a head box having a suspension-discharging outlet disposed above a portion of said reach and having a predetermined length and width, as considered respectively in and transversely of said direction, said head box including two side walls flanking said outlet; a foraminous support disposed below said reach opposite said outlet to permit the liquid to flow through said wire and said support whereby at least some fibers remain on and form a mat which advances with said reach in said direction; means for regulating the effective width of said mat including a deckle located immediately above said reach, extending in said direction substantially along the full length of said outlet and having a width which is a small fraction of the width of said outlet, said deckle including an elongated partition extending upwardly from said reach and one of said side walls defining with said partition a compartment which overlies a predetermined area of said portion of said reach and is at least substantially sealed against entry of suspension, said partition having a rear portion, as considered in said direction; means for articulately coupling said rear portion to said one side wall; and means for moving said deckle sideways to any one of a plurality of positions in each of which said deckle prevents the liquid from flowing through a different elongated zone of said portion of said reach.

27. Apparatus as defined in claim 26, wherein said coupling means comprises a bellows.

28. Apparatus as defined in claim 26, wherein said partition is located in a plane which is substantially normal to said portion of said reach of said wire and said partition is substantially parallel to said one side wall in each of said positions thereof.

29. Apparatus as defined in claim 26, wherein said coupling means comprises at least one hinge.

30. Apparatus as defined in claim 26, wherein said coupling means comprises a follower and said one side wall has means for guiding said follower during sidewise movement of said partition.

31. Apparatus as defined in claim 26, wherein said rear portion of said partition has a socket and said coupling means includes a member which is articulately connected to said one side wall and slides in said socket in response to sidewise movement of said partition.

32. Apparatus as defined in claim 26, wherein said coupling means comprises a guide having a front portion and a rear portion, and a hinge articulately connecting said rear portion of said guide to said one side wall, said rear portion of said partition having a socket and said couplng means further comprising a member articulately connected with the front portion of said guide and extending into and being slidable in said socket.

33. Apparatus as defined in claim 32, wherein said hinge has a pivot axis which is substantially normal to said portion of said reach of said wire and said member is pivotable relative to said guide about a second axis which is parallel to said first mentioned axis.

34. Apparatus for forming sheets from a dilute suspension of fibers in a liquid, comprising an endless wire having an elongated reach which moves in a predetermined direction; a head box having a suspension-discharging outlet disposed above a portion of said reach and having a predetermined length and width, as considered respectively in and transversely of said direction, said head box including two side walls flanking said outlet; a foraminous support disposed below said reach opposite said outlet to permit the liquid to flow through said wire and said support whereby at least some fibers remain on and form a mat which advances with said reach in said direction; means for regulating the effective width of said mat including a deckle located immediately above said reach, extending in said direction substantially along the full length of said outlet and having a width which is a small fraction of the width of said outlet, said deckle including an elongated partition extending upwardly from said reach and one of said side walls defining with said partition a compartment which overlies a predetermined area of said portion of said reach and is at least substantially sealed against entry of suspension; and means for moving said deckle sideways to any one of a plurality of positions in each of which said deckle prevents the liquid from flowing through a different elongated zone of said portion of said reach, including at least one displacing member extending outwardly through said one side wall.

35. Apparatus as defined in claim 34, wherein said displacing member comprises a feed screw and said moving means further comprises an internally threaded rotary member mounted at the outer side of said one side wall and meshing with said feed screw.

36. Apparatus for forming sheets from a dilute suspension of fibers in a liquid, comprising an endless wire having an elongated reach which moves in a predetermined direction; a head box having a suspension-discharging outlet above said portion of said reach and having a predetermined length and width, as considered respectively in and transversely of said direction, said head box including two side walls flanking said outlet; a foraminous support disposed below said reach opposite said outlet to permit the liquid to flow through said wire and said support whereby at least some fibers remain on and form a mat which advances with said reach in said direction; means for regulating the effective width of said mat including a deckle located immediately above said reach, extending in said direction substantially along the full length of said outlet and having a width which is a small fracton of the width of said outlet, said deckle including an elongated partition extending upwardly from said reach and one of said side walls defining with said partition a compartment which overlies a predetermined area of said portion of said reach and is at least substantially sealed against entry of suspension, said partition having an upper portion adjacent to said one side wall and a lower portion adjacent to said portion of said reach; and means for moving said deckle sideways to any one of a plurality of positions in each of which said deckle prevents the liquid from flowing through a different elongated zone of said portion of said reach, including means for coupling said upper portion of said partition to said one side wall for movement up and down relative to said one side wall and means for moving said lower portion of said partition sideways along said portion of said reach.

37. Apparatus for forming sheets from a dilute suspension of fibers in a liquid, comprising an endless wire having an elongated reach which moves in a predetermined direction; a head box having a suspension-discharging outlet disposed above a portion of said reach and having a predetermined length and width, as considered respectively in and transversely of said direction, said head box including a bottom wall located rearwardly of said outlet, as considered in said direction, and two side walls flanking said outlet; a foraminous support disposed below said reach opposite said outlet to permit the liquid to flow through said wire and said support whereby at least some fibers remain on and form a mat which advances with said reach in said direction; means for regulating the effective width of said mat including a deckle extending in said direction substantially along the full length of said outlet and having a width which is a small fraction of the width of said outlet, said deckle including a front portion located above said portion of said reach, a rear portion overlying said bottom and a partition which defines a compartment with one of said side walls; and means for moving said deckle sideways to any one of a plurality of positions in each of which said deckle prevents the liquid from flowing through a different elongated zone of said portion of said reach.

38. Apparatus for forming sheets from a dilute suspension of fibers in a liquid, comprising an endless wire having an elongated reach which moves in a predetermined direction; a head box having a suspension-discharging outlet disposed above a portion of said reach and having a predetermined length and width, as considered respectively in and transversely of said direction, said head box including a bottom wall located rearwardly of said outlet, as considered in said direction, and two side walls flanking said outlet; a foraminous support disposed below said reach opposite said outlet to permit the liquid to flow through said wire and said suport whereby at least some fibers remain on and form a mat which advances with said reach in said direction; means for regulating the effective width of said mat including a deckle extending in said direction substantially along the full length of said outlet and having a width which is a small fraction of the width of said outlet, said deckle including a front portion located above said portion of said reach, a rear portion overlying said bottom wall and a partition defining a compartment with one of said side walls; means for admitting a liquid into said compartment whereby the liquid in said compartment prevents the penetration of appreciable quantities of suspension into said compartment; and means for moving said deckle sideways to any one of a plurality of positions in each of which said deckle prevents the liquid from flowing through a different elongated zone of said portion of said reach.

39. Apparatus as defined in claim 38, further comprising means for throttling the outflow of liquid from said compartment.

40. Apparatus as defined in claim 39, wherein said throttling means comprises a baffle which is adjacent to said portion of said reach of said wire.

41. Apparatus for forming sheets from a dilute suspension of fibers in a liquid, comprising an endless wire having an elongated reach which moves in a predetermined direction; a head box having a suspension-discharging outlet disposed above a portion of said reach and having a predetermined length and width, as considered respectively in and transversely of said direction, said head box including two side walls flanking said outlet; a foraminous support disposed below said reach opposite said outlet to permit the liquid to flow through said wire and said support whereby at least some fibers remain on and form a mat which advances with said reach in said direction; means for regulating the effective width of said mat including a deckle extending in said direction substantially along the full length of said outlet and having a width which is a small fraction of the width of said outlet; means for moving said deckle sideways to any one of a plurality of positions in each of which said deckle prevents the liquid from flowing through a different elongated zone of said portion of said reach, said deckle being movable to at least one position in which it is at least slightly spaced apart from one of said side walls; and means for collecting fibers which deposit on said portion of said reach between said one side wall and said deckle in said one position of said deckle, including a suction head in the interior of said head box.

42. Apparatus as defined in claim 41, wherein said suction head is of variable width, as considered transversely of said direction, so that the width of said suction head at least approximates the distance between said deckle and said one side wall of said head box.

43. Apparatus as defined in claim 41, wherein said head box further comprises a front wall located in front of said outlet, as considered in said direction, and said suction head is closely adjacent to said front wall.

44. Apparatus as defined in claim 41, further comprising a baffle adjacent to said portion of said reach of said wire at a level below said suction head to obstruct the flow of liquid from said outlet through said wire and said support.

* * * * *